US009925639B2

(12) United States Patent
Suh et al.

(10) Patent No.: US 9,925,639 B2
(45) Date of Patent: Mar. 27, 2018

(54) CLEANING OF CHAMBER COMPONENTS WITH SOLID CARBON DIOXIDE PARTICLES

(71) Applicant: Applied Materials, Inc., Santa Clara, CA (US)

(72) Inventors: Song-Moon Suh, Sunnyvale, CA (US); Yuanhong Guo, Mountain View, CA (US); Guangchi Xuan, Sunnyvale, CA (US); Pulkit Agarwal, Santa Clara, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 448 days.

(21) Appl. No.: 14/335,291

(22) Filed: Jul. 18, 2014

(65) Prior Publication Data

US 2016/0016286 A1 Jan. 21, 2016

(51) Int. Cl.
*B24C 1/00* (2006.01)
*B08B 3/04* (2006.01)

(52) U.S. Cl.
CPC ..... *B24C 1/003* (2013.01); *B08B 3/04* (2013.01); *B24C 1/00* (2013.01)

(58) Field of Classification Search
CPC ..... B24C 1/00; B24C 1/003; B08B 3/04
USPC ..... 451/38, 39, 40; 134/7
See application file for complete search history.

(56) References Cited

U.S. PATENT DOCUMENTS 5,125,979 A * 6/1992 Swain ..... C01B 31/22 134/7
5,364,472 A * 11/1994 Heyns ..... B08B 7/0092 134/18
5,601,478 A * 2/1997 Mesher ..... B05B 5/032 239/591
5,605,484 A * 2/1997 Bailey ..... H01J 9/02 445/59
5,651,834 A * 7/1997 Jon ..... B08B 7/02 134/26
5,837,064 A * 11/1998 Bowers ..... B08B 6/00 134/6
6,146,466 A * 11/2000 Bowers ..... B08B 6/00 134/1
6,852,173 B2 * 2/2005 Banerjee ..... B08B 3/04 134/2
6,875,286 B2 * 4/2005 Cotte ..... B08B 7/0021 134/18

(Continued)

*Primary Examiner* — Eileen Morgan
(74) *Attorney, Agent, or Firm* — Lowenstein Sandler LLP

(57) ABSTRACT

Disclosed herein are systems and methods for cleaning a ceramic article using a stream of solid carbon dioxide ($CO_2$) particles. A method includes flowing liquid $CO_2$ into a spray nozzle, and directing a first stream of solid $CO_2$ particles from the spray nozzle toward a ceramic article for a first time duration to clean the ceramic article. The liquid $CO_2$ is converted into the first stream of solid $CO_2$ particles upon exiting the spray nozzle. The first stream of solid $CO_2$ particles causes a layer of solid $CO_2$ to be formed on the ceramic article. After the layer of solid $CO_2$ has sublimated, a second stream of solid $CO_2$ particles is directed from the spray nozzle toward the ceramic article for at least one of the first time duration or a second time duration to further clean the ceramic article.

19 Claims, 4 Drawing Sheets

(56) References Cited

U.S. PATENT DOCUMENTS 8,292,698 B1 * 10/2012 Shih ..... B24C 1/003
451/37
8,454,409 B2 * 6/2013 Bowers ..... B24C 1/003
451/102

* cited by examiner

CLEANING OF CHAMBER COMPONENTS WITH SOLID CARBON DIOXIDE PARTICLES

TECHNICAL FIELD

Embodiments of the present invention relate, in general, to cleaning semiconductor chamber components.

BACKGROUND

In the semiconductor industry, devices are fabricated by a number of manufacturing processes producing structures of ever-decreasing size. As the critical dimensions for semiconductor devices continue to shrink, there is an unyielding need to improve the cleanliness of the processing environment within a semiconductor process chamber. Such contamination may be caused, in part, by chamber components. For example, contamination may be caused by gas delivery components, such as a nozzle or showerhead.

For ceramic chamber components, ceramic particles (e.g., yttrium oxide, aluminum oxide, zirconium oxide, etc.) tend to peel off during exposure to vacuum and plasma conditions, resulting in wafer defects. Standard cleaning methods are often ineffective in removing the ceramic particles from the chamber components. While high quality materials have been used in chamber components in an effort to reduce particle defects, these materials often drive up the manufacturing costs of the chamber components sometimes as much as three-fold or greater.

SUMMARY

Embodiments of the present disclosure relate to the cleaning of ceramic articles using streams of solid carbon dioxide ($CO_2$) particles. In one embodiment, a method includes flowing liquid $CO_2$ into a spray nozzle, and directing a first stream of solid $CO_2$ particles from the spray nozzle toward a ceramic article for a first time duration to clean the ceramic article. The liquid $CO_2$ is converted into the first stream of solid $CO_2$ particles upon exiting the spray nozzle. The first stream of solid $CO_2$ particles causes a layer of solid $CO_2$ to be formed on the ceramic article. After the layer of solid $CO_2$ has sublimated, a second stream of solid $CO_2$ particles is directed from the spray nozzle toward the ceramic article for at least one of the first time duration or a second time duration to further clean the ceramic article.

In another embodiment, an apparatus includes a mounting fixture, a spray nozzle to generate a stream of solid $CO_2$ particles toward a ceramic article held by the mounting fixture, and a controller. The controller is configured to direct the stream of solid $CO_2$ particles toward the ceramic article for a first time duration to clean the ceramic article, in which the stream of solid $CO_2$ particles causes a layer of solid $CO_2$ to be formed on the ceramic article. The controller is further configured to stop the stream of solid $CO_2$ particles for a second time duration, in which the layer of solid $CO_2$ sublimates during the second time duration. The controller is further configured to direct the stream of solid $CO_2$ particles toward the ceramic article for a third time duration, after the layer of solid CO2 has sublimated, to further clean the ceramic article.

In another embodiment, a chamber component includes a ceramic body having been cleaned by a process including directing a first stream of solid $CO_2$ particles from a spray nozzle toward the ceramic article for a first time duration, in which the first stream of solid $CO_2$ particles causes a first layer of solid $CO_2$ to be formed on the ceramic article. The process further includes directing a second stream of solid $CO_2$ particles from the spray nozzle toward the ceramic article for at least one of the first time duration or a second time duration, after the first layer of solid $CO_2$ has sublimated. A particle defect density of the ceramic body after the cleaning process is less than or equal to approximately 10 particles per square-millimeter for particles having diameters greater than or equal to 1 micrometer.

BRIEF DESCRIPTION OF THE DRAWINGS

The present invention is illustrated by way of example, and not by way of limitation, in the figures of the accompanying drawings in which like references indicate similar elements. It should be noted that different references to "an" or "one" embodiment in this disclosure are not necessarily to the same embodiment, and such references mean at least one.

DETAILED DESCRIPTION OF EMBODIMENTS

Figure 1:
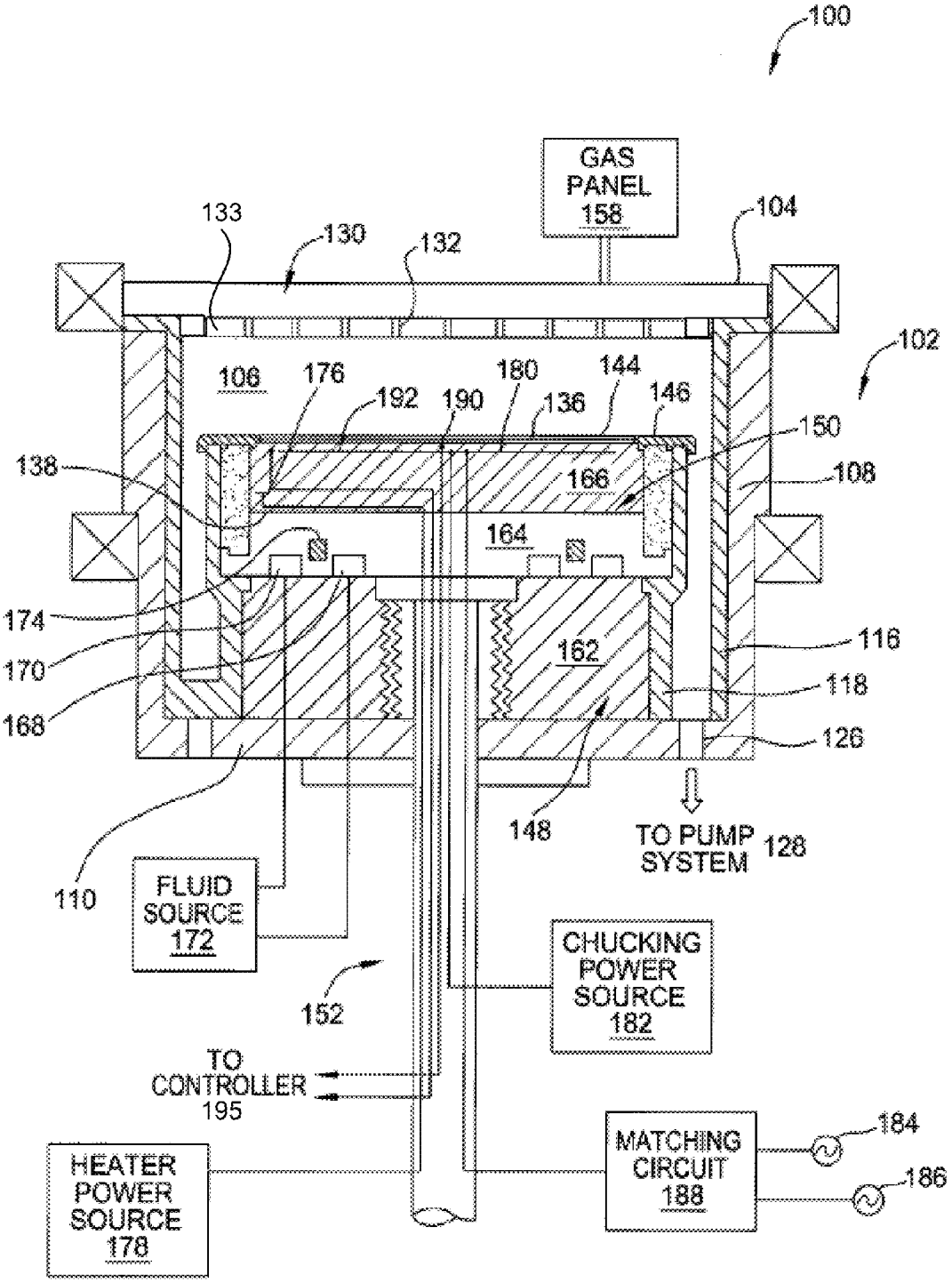
FIG. 1 depicts a sectional view of a processing chamber according to an embodiment.

Embodiments of the present invention provide for $CO_2$-based cleaning of an article, such as a chamber component for a processing chamber. The article may be a ceramic article having a composition of one or more of $Al_2O_3$, AlN, $SiO_2$, $Y_3Al_5O_{12}$ (YAG), $Y_4Al_2O_9$ (YAM), $Y_2O_3$, $Er_2O_3$, $Gd_2O_3$, $Gd_3Al_5O_{12}$ (GAG), $YF_3$, $Nd_2O_3$, $Er_4Al_2O_9$, $Er_3Al_5O_{12}$ (EAG), $ErAlO_3$, $Gd_4Al_2O_9$, $GdAlO_3$, $Nd_3Al_5O_{12}$, $Nd_4Al_2O_9$, $NdAlO_3$, or a ceramic compound composed of $Y_4Al_2O_9$ and a solid-solution of $Y_2O_3$—$ZrO_2$. The article may be a ceramic article having at least one ceramic layer or a non-ceramic layer (e.g., an anodized aluminum layer) disposed thereon. The article may include one or more apertures passing through (e.g., to allow for gas flow through the article and into a processing chamber).

In one embodiment, liquid $CO_2$ is flowed into a spray nozzle at a pressure of between 700-900 pounds per square inch (PSI). The liquid $CO_2$ is converted into a stream of pressurized solid $CO_2$ particles as it leaves the spray nozzle. The stream of solid $CO_2$ particles is directed toward a ceramic article for a first time duration to clean the ceramic article. The stream of solid $CO_2$ particles additionally causes a layer of solid $CO_2$ to be formed on the ceramic article. The stream of pressurized solid $CO_2$ particles is halted for a time period to allow the ceramic article to heat up (e.g., to room temperature) and the layer of solid $CO_2$ to sublimate. After the layer of solid $CO_2$ has sublimated, another stream of solid $CO_2$ particles is directed from the spray nozzle toward the ceramic article for at least one of the first time duration or a second time duration to further clean the ceramic article.

In general, articles, such as ceramic chamber components, tend to have particle defects along their exterior and interior surfaces (e.g., within apertures) as a consequence of the fabrication process. The article cleaning systems and methods described herein contact an article with a stream of solid $CO_2$ particles to remove the particle defects from the article. The stream of solid $CO_2$ particles dislodges particles from the ceramic article. Additionally, the solid $CO_2$ particles sublimate after impacting the ceramic article without introducing any additional particles to the article. Thus, the embodiments of cleaning techniques that use solid $CO_2$ particles described herein may reduce particle contamination introduced by the article during processing of wafers or other substrates.

The improved performance of chamber components cleaned according to the embodiments herein advantageously facilitates processing of semiconductor wafers. This is achieved by removing particle defects from the chamber components that may ultimately be deposited on wafers during subsequent wafer processing. The embodiments described herein provide a less expensive alternative to using expensive, higher quality bulk ceramics to fabricate chamber components. Moreover, the embodiments described herein are advantageous over solution-based cleaning methods that are relatively ineffective in removing particle defects from chamber components.

FIG. 1 is a sectional view of a semiconductor processing chamber 100, in accordance with one embodiment. The processing chamber 100 may be used for processes in which a corrosive plasma environment is provided. For example, the processing chamber 100 may be a chamber for a plasma etcher or plasma etch reactor, a plasma cleaner, and so forth. In alternative embodiments other processing chambers may be used, which may or may not be exposed to a corrosive plasma environment. Some examples of chamber components include a chemical vapor deposition (CVD) chamber, a physical vapor deposition (PVD) chamber, an ion assisted deposition (IAD) chamber, and other types of processing chambers.

Examples of chamber components that may be cleaned according to embodiments described herein include, but are not limited to, a substrate support assembly 148, an electrostatic chuck (ESC) 150, a gas distribution plate, a nozzle, a showerhead, a flow equalizer, a cooling base, a gas feeder, a chamber lid 104, a liner, a ring, a view port, and so on. Embodiments may be used with chamber components that include one or more apertures as well as with chamber components that do not include any apertures. The chamber component may be a ceramic article having a compositing of at least one of $Al_2O_3$, AlN, $SiO_2$, $Y_3Al_5O_{12}$, $Y_4Al_2O_9$, $Y_2O_3$, $Er_2O_3$, $Gd_2O_3$, $Gd_3Al_5O_{12}$, $YF_3$, $Nd_2O_3$, $Er_4Al_2O_9$, $Er_3Al_5O_{12}$, $ErAlO_3$, $Gd_4Al_2O_9$, $GdAlO_3$, $Nd_3Al_5O_{12}$, $Nd_4Al_2O_9$, $NdAlO_3$, or a ceramic compound composed of $Y_4Al_2O_9$ and a solid-solution of $Y_2O_3$—$ZrO_2$. Alternatively, the chamber component may be another ceramic, may be a metal (e.g., Al, stainless steel, etc.), or a metal alloy. The chamber component may also include both a ceramic portion and a non-ceramic (e.g., metal) portion.

In one embodiment, the processing chamber 100 includes a chamber body 102 and a showerhead 130 that enclose an interior volume 106. Alternatively, the showerhead 130 may be replaced by a lid and a nozzle in some embodiments. The chamber body 102 may be fabricated from aluminum, stainless steel or other suitable material. The chamber body 102 generally includes sidewalls 108 and a bottom 110. One or more of the showerhead 130 (or lid and/or nozzle), sidewalls 108 and/or bottom 110 may include a one or more apertures.

An outer liner 116 may be disposed adjacent the sidewalls 108 to protect the chamber body 102. The outer liner 116 may be fabricated to include one or more apertures. In one embodiment, the outer liner 116 is fabricated from aluminum oxide.

An exhaust port 126 may be defined in the chamber body 102, and may couple the interior volume 106 to a pump system 128. The pump system 128 may include one or more pumps and throttle valves utilized to evacuate and regulate the pressure of the interior volume 106 of the processing chamber 100.

The showerhead 130 may be supported on the sidewall 108 of the chamber body 102. The showerhead 130 (or lid) may be opened to allow access to the interior volume 106 of the processing chamber 100, and may provide a seal for the processing chamber 100 while closed. A gas panel 158 may be coupled to the processing chamber 100 to provide process and/or cleaning gases to the interior volume 106 through the showerhead 130 or lid and nozzle (e.g., through apertures of the showerhead or lid and nozzle). Showerhead 130 may be used for processing chambers used for dielectric etch (etching of dielectric materials). The showerhead 130 includes a gas distribution plate (GDP) 133 having multiple gas delivery apertures 132 throughout the GDP 133. The showerhead 130 may include the GDP 133 bonded to an aluminum base or an anodized aluminum base. The GDP 133 may be made from Si or SiC, or may be a ceramic such as $Y_2O_3$, $Al_2O_3$, YAG, and so forth.

For processing chambers used for conductor etch (etching of conductive materials), a lid may be used rather than a showerhead. The lid may include a center nozzle that fits into a center hole of the lid. The lid may be a ceramic such as $Al_2O_3$, $Y_2O_3$, YAG, or a ceramic compound composed of $Y_4Al_2O_9$ and a solid-solution of $Y_2O_3$—$ZrO_2$. The nozzle may also be a ceramic, such as $Y_2O_3$, YAG, or the ceramic compound composed of $Y_4Al_2O_9$ and a solid-solution of $Y_2O_3$—$ZrO_2$. The lid, base of showerhead 130, GDP 133 and/or nozzle may be coated with a ceramic layer, which may be composed of one or more of any of the ceramic compositions described herein. The ceramic layer may be a plasma sprayed layer, a physical vapor deposition (PVD) deposited layer, an ion assisted deposition (IAD) deposited layer, or other type of layer. In one embodiment, the ceramic layer may have been coated onto the chamber component prior to formation of apertures. It is noted that any of the chamber components described herein may have ceramic layers or other types of layers, such as anodized aluminum layers.

Examples of processing gases that may be used to process substrates in the processing chamber 100 include halogen-containing gases, such as $C_2F_6$, $SF_6$, $SiCl_4$, HBr, $NF_3$, $CF_4$, $CHF_3$, $CH_2F_3$, F, $NF_3$, $Cl_2$, $CCl_4$, $BCl_3$ and $SiF_4$, among others, and other gases such as $O_2$, or $N_2O$. Examples of carrier gases include $N_2$, He, Ar, and other gases inert to process gases (e.g., non-reactive gases). The substrate support assembly 148 is disposed in the interior volume 106 of the processing chamber 100 below the showerhead 130 or lid. The substrate support assembly 148 holds the substrate 144 during processing. A ring 146 (e.g., a single ring) may cover a portion of the electrostatic chuck 150, and may protect the covered portion from exposure to plasma during processing. The ring 146 may be silicon or quartz in one embodiment.

An inner liner 118 may be coated on the periphery of the substrate support assembly 148. The inner liner 118 may be a halogen-containing gas resistant material such as those discussed with reference to the outer liner 116. In one embodiment, the inner liner 118 may be fabricated from the same materials of the outer liner 116. Additionally, the inner liner 118 may be coated with a ceramic layer and/or have one or more apertures passing through.

In one embodiment, the substrate support assembly 148 includes a mounting plate 162 supporting a pedestal 152, and an electrostatic chuck 150. The electrostatic chuck 150 further includes a thermally conductive base 164 and an electrostatic puck 166 bonded to the thermally conductive base by a bond 138, which may be a silicone bond in one embodiment. An upper surface of the electrostatic puck 166 is covered by the ceramic layer 136 in the illustrated embodiment. In one embodiment, the ceramic layer 136 is disposed on the upper surface of the electrostatic puck 166. In another embodiment, the ceramic layer 136 is disposed on the entire exposed surface of the electrostatic chuck 150 including the outer and side periphery of the thermally conductive base 164 and the electrostatic puck 166. The mounting plate 162 is coupled to the bottom 110 of the chamber body 102 and includes passages for routing utilities (e.g., fluids, power lines, sensor leads, etc.) to the thermally conductive base 164 and the electrostatic puck 166.

The thermally conductive base 164 and/or electrostatic puck 166 may include one or more optional embedded heating elements 176, embedded thermal isolators 174 and/or conduits 168, 170 to control a lateral temperature profile of the substrate support assembly 148. The conduits 168, 170 may be fluidly coupled to a fluid source 172 that circulates a temperature regulating fluid through the conduits 168, 170. The embedded thermal isolator 174 may be disposed between the conduits 168, 170 in one embodiment. The heating element 176 is regulated by a heater power source 178. The conduits 168, 170 and heating element 176 may be utilized to control the temperature of the thermally conductive base 164, which may be used for heating and/or cooling the electrostatic puck 166 and a substrate 144 (e.g., a wafer) being processed. The temperature of the electrostatic puck 166 and the thermally conductive base 164 may be monitored using a plurality of temperature sensors 190, 192, which may be monitored using a controller 195.

The electrostatic puck 166 may further include multiple gas passages or apertures such as grooves, mesas and other surface features, which may be formed in an upper surface of the electrostatic puck 166 and/or the ceramic layer 136. The gas passages may be fluidly coupled to a source of a heat transfer (or backside) gas such as helium via apertures drilled in the electrostatic puck 166. In operation, the backside gas may be provided at controlled pressure into the gas passages to enhance the heat transfer between the electrostatic puck 166 and the substrate 144. The electrostatic puck 166 includes at least one clamping electrode 180 controlled by a chucking power source 182. The clamping electrode 180 (or other electrode disposed in the electrostatic puck 166 or conductive base 164) may further be coupled to one or more RF power sources 184, 186 through a matching circuit 188 for maintaining a plasma formed from process and/or other gases within the processing chamber 100. The power sources 184, 186 are generally capable of producing an RF signal having a frequency from about 50 kHz to about 3 GHz, with a power output of up to about 10,000 Watts.

Figure 2:
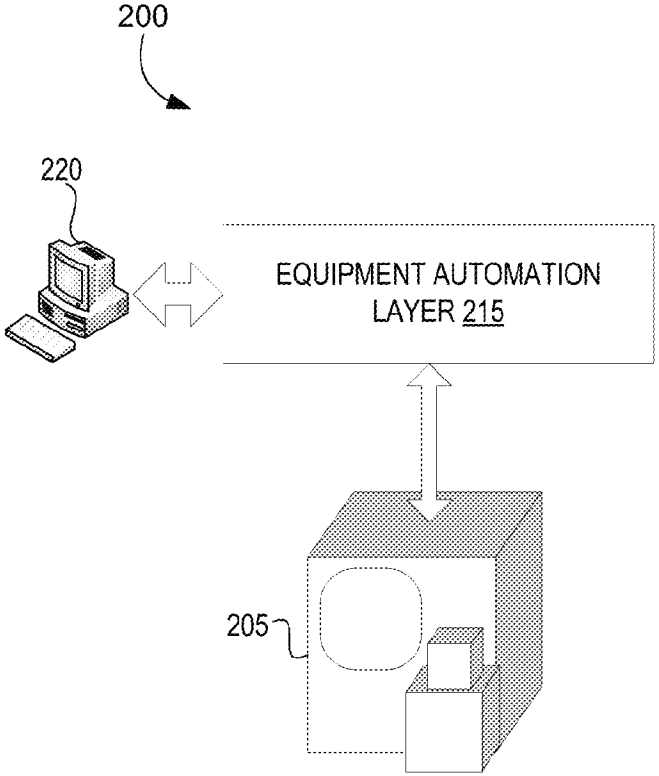
FIG. 2 depicts an exemplary architecture of a manufacturing system according to an embodiment.

FIG. 2 illustrates an exemplary architecture of a manufacturing system 200 according to one embodiment. The manufacturing system 200 may be a ceramics manufacturing system, which may include the processing chamber 100. In some embodiments, the manufacturing system 200 may be a processing chamber for manufacturing, cleaning, or modifying a chamber component of the processing chamber 100. In one embodiment, the manufacturing system 200 includes an article cleaning system 205, an equipment automation layer 215, and a computing device 220. In alternative embodiments, the manufacturing system 200 may include more or fewer components. For example, the manufacturing system 200 may include only the article cleaning system 205, which may be a manual off-line machine.

The article cleaning system 205 may be a machine designed to direct a stream of solid $CO_2$ particles toward one or more surfaces of an article (e.g., a ceramic article for use in a semiconductor processing chamber). The article cleaning system 205 may include an adjustable mounting fixture used to hold the article in place during cleaning. The article cleaning system 205 may also include a store of liquid $CO_2$, and a spray nozzle for generating a stream of solid $CO_2$ particles from the liquid $CO_2$.

The article cleaning system 205 may be an off-line machine that can be programmed with a process recipe (e.g., using a programmable controller). The process recipe may control a clamping force used to hold an article, an orientation of the article, $CO_2$ pressure in the nozzle, orientation of the nozzle with respect to the article, process time durations, article temperature and/or chamber temperature, or any other suitable parameter. Each of these process parameters will be discussed in greater detail below. Alternatively, article cleaning system 205 may be an on-line automated machine that can receive process recipes from computing devices 220 (e.g., personal computers, server machines, etc.) via an equipment automation layer 215. The equipment automation layer 215 may interconnect the article cleaning system 205 with computing devices 220, with other manufacturing machines, with metrology tools, and/or other devices.

The equipment automation layer 215 may include a network (e.g., a location area network (LAN)), routers, gateways, servers, data stores, and so on. The article cleaning system 205 may connect to the equipment automation layer 215 via a SEMI Equipment Communications Standard/Generic Equipment Model (SECS/GEM) interface, via an Ethernet interface, and/or via other interfaces. In one embodiment, the equipment automation layer 215 enables process data to be stored in a data store (not shown). In an alternative embodiment, the computing device 220 connects directly to the article cleaning system 205.

In one embodiment, the article cleaning system 205 includes a programmable controller that can load, store and execute process protocols. The programmable controller may control pressure settings, fluid flow settings, time settings, etc. for a process performed by article cleaning system 205. The programmable controller may include a main memory (e.g., read-only memory (ROM), flash memory, dynamic random access memory (DRAM), static random access memory (SRAM), etc.), and/or a secondary memory (e.g., a data storage device such as a disk drive). The main memory and/or secondary memory may store instructions for cleaning a ceramic article, as described herein.

The programmable controller may also include a processing device coupled to the main memory and/or secondary memory (e.g., via a bus) to execute the instructions. The processing device may be a general-purpose processing device such as a microprocessor, central processing unit, or the like. The processing device may also be a special-purpose processing device, such as an application specific integrated circuit (ASIC), a field programmable gate array (FPGA), a digital signal processor (DSP), a network processor, or the like. In one embodiment, programmable controller is a programmable logic controller (PLC).

Figure 3:
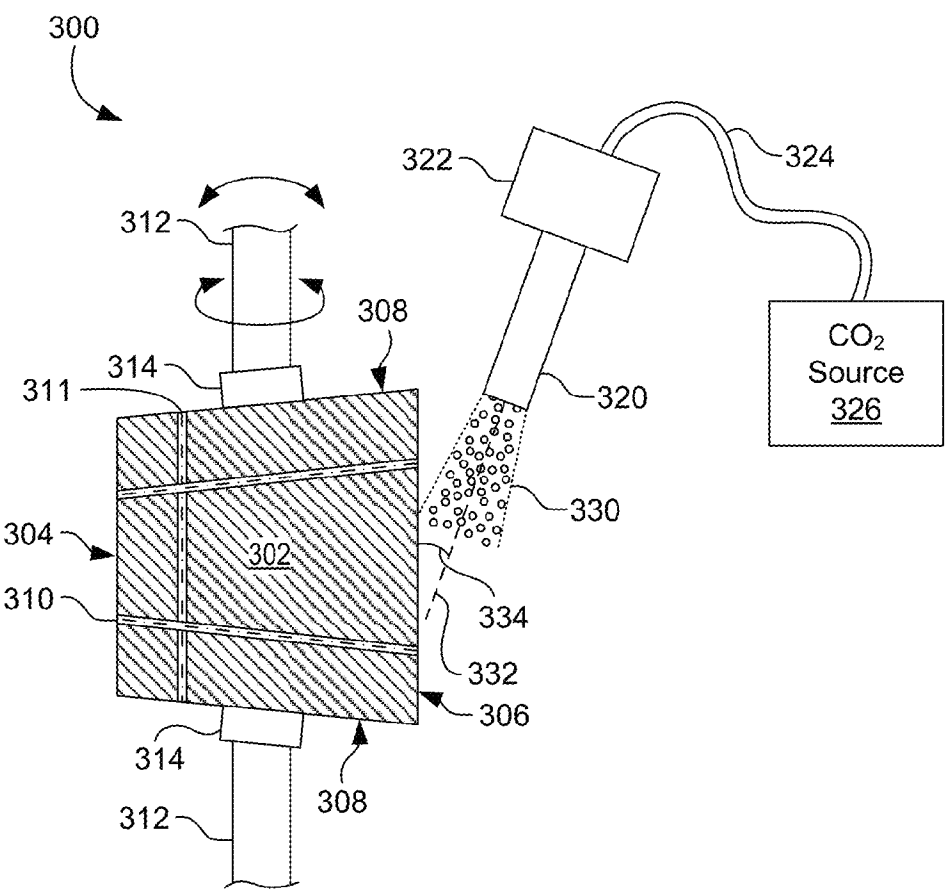
FIG. 3 depicts an exemplary article cleaning system according to an embodiment.

FIG. 3 depicts an exemplary article cleaning system 300 according to an embodiment. For example, the article cleaning system 300 may be the same or similar to article cleaning system 205 described with respect to FIG. 2. The article cleaning system 300 may be configured to "dry clean" an article 302 using a stream of solid $CO_2$ particles. The article 302 may be any suitable chamber component described with respect to FIG. 1, including a substrate support assembly, an electrostatic chuck (ESC), a chamber wall, a base, a gas distribution plate or showerhead, a liner, a liner kit, a shield, a plasma screen, a flow equalizer, a cooling base, a chamber lid, etc. The article 302 may be a ceramic material, metal-ceramic composite, or a polymer-ceramic composite. The article 302 may have any suitable dimensions for incorporation into a semiconductor chamber. For example, in some embodiments, the article 302 may be a nozzle having a thickness between about 50 mm to about 200 mm, having one or more apertures on a top, bottom and/or sides, and/or having one or more diameters between about 100 to about 500 mm.

As illustrated in FIG. 3, the article 302 is a nozzle having a top surface 304, one or more side surfaces 308, and a plasma-contacting surface 306. The top surface 304 may correspond to a top portion of the article 302 that mounts to a portion of a processing chamber and interfaces with a gas-flow manifold or gas source. Accordingly, the top surface 304 may not be contacted with a plasma during operation of the processing chamber. Similarly, the one or more side surfaces 308 may also mount to a portion of the processing chamber. The side surfaces 308 may not contact the plasma, or a fraction of the side surfaces 308 may contact the plasma. The plasma-contacting surface (or "bottom surface") 306 may correspond to a portion of the article 302 through which gas flows into the processing chamber, and that is in contact with a plasma during operation of the processing chamber.

As illustrated in FIG. 3, the article 302 may include one or more apertures 310, which pass through the article 302 from the top surface 304 to the plasma-contacting surface 306 (e.g., from a top surface to a bottom surface). The one or more apertures 310 may have any suitable shapes, such as circular, c-slot, etc. Other shapes of the apertures 310 may also be provided. The article 302 may also include one or more apertures 311 that pass through the side surface 308 (e.g., from one side surface to another side surface) and/or from a side surface 308 to the top or bottom surfaces. In one embodiment one or more of apertures 310 may intersect with one or more of apertures 311. In another embodiment, none of apertures 310 intersect with apertures 311.

The article 302 may be held in place by an adjustable mounting fixture 312, which may contact the article in two or more locations as shown. For example, grips 314 (which may be a rubber material such as neoprene, urethane, polyoxymethylene, etc.) may contact surfaces of the article 302 to prevent the article 302 from slipping. The grips 314 may be applied to the article 302 with enough force to firmly hold the article 302 in place while also minimizing the contact area with the article 302. The mounting fixture 312 may be part of a larger assembly that is automatically and/or manually adjustable to position the article 302 during the cleaning process, and may be capable of rotating, tilting, or translating the article 302 in three dimensions.

Article cleaning system 300 also includes spray nozzle 320, which is fluidly coupled to a liquid $CO_2$ source 326 (e.g., a source of liquid $CO_2$ having a purity greater than or equal to 99.9999999%) via a supply line 324. The supply line 324 may include one or more valves. Additionally, a pump may be used to pump the liquid $CO_2$ from the $CO_2$ source through the spray nozzle 320 and to control a pressure of the liquid $CO_2$.

The spray nozzle may be positioned and maintained at a distance of about 0.5 inches to about 2 inches from a surface of the article 302 (e.g., about 1 inch from the surface of the article 302 in one embodiment). In one embodiment, the mounting fixture 312 may translate the article 302 toward and away from the spray nozzle 320 to maintain the distance or range of distances. Alternatively, or additionally, the spray nozzle 320 may be translated toward and away from the article 302. In some embodiments, the liquid $CO_2$ passes through a fine mesh filter 322 (e.g., a nickel mesh filter) to remove gross particulates ($CO_2$ particles having a size greater than a spacing of the mesh) from the liquid $CO_2$ source and/or supply line 324 prior to exiting from the spray nozzle 320. The fine mesh filter 322 may be positioned at an input of the spray nozzle 320 as shown, at an output of the spray nozzle 320, or at an intermediate position within the spray nozzle 320.

As the liquid $CO_2$ exits the spray nozzle, the liquid $CO_2$ is converted into a stream 330 of solid $CO_2$ particles, directed toward the article 302 along a stream path 332. In some embodiments, the liquid $CO_2$ is supplied to the spray nozzle 320 at a pressure between about 700 psi and about 900 psi (e.g., about 838 psi in one embodiment). In some embodiments, the spray nozzle 320 is a throttling nozzle, which causes an isenthalpic expansion of the liquid carbon dioxide, such that when the $CO_2$ exits the spray nozzle 320, it expands into the stream of solid $CO_2$ particles. In some embodiments, the stream of solid $CO_2$ particles exits through an aperture of the spray nozzle 320 having a diameter that is less than about 1 millimeter.

Without being bound by theory, it is believed that the solid $CO_2$ particles strike particle defects on surfaces of the article 302, transferring momentum to the particle defects that removes them from the surfaces. In some embodiments, the stream path 332 is oriented at an angle 334 with respect to a surface of the article 302, which may provide higher momentum to the particle defects while minimizing damage to the article 302 that may occur from orienting the stream path 332 directly toward the article 302. In one embodiment, the angle may be between about 15° and 45° (e.g., about 30° in one embodiment). In some embodiments, the order in which portions of the article 302 are exposed to the stream 330 may be specified (e.g., in the process recipe executed by the controller). For example, the top surface 304 may be exposed to the stream 330 initially. The mounting fixture 312 may then orient (e.g., rotate, tilt, and/or translate) the article 302 such that the side surface 308 are exposed to the stream 330 (e.g., at an angle of 30°). The mounting fixture 312 may then orient the article 302 such that the plasma-contacting surface 306 is exposed to the stream 330 (as illustrated in FIG. 3). This order may optimize the cleaning process by eliminating particle defects that may have landed on the plasma-contacting surface 306 so that these particle defects are not transferred to a wafer during plasma processing.

In some embodiments, multiple iterations of cleaning are performed for the article. In each cleaning iteration, the article 302 and/or spray nozzle 320 may be rotated, translated and/or otherwise repositioned to clean different portions of the article in a specified order and manner. The cleaning process described in embodiments may cause the article to cool, and may further cause a buildup of solid $CO_2$ on surfaces of the article. In one embodiment, each cleaning iteration is separated by a thaw period. During the thaw period, no $CO_2$ particles are sprayed at the article, and the article is allowed to heat (e.g., to room temperature). During this time, the buildup of solid $CO_2$ sublimates from the surface of the article. In one embodiment, the article 302 and/or a chamber of the article cleaning system 300 is heated (e.g., via resistive heating elements, heat lamps, etc.) to accelerate the sublimation process. For example, the article 302 may be heated to maintain a temperature to be within a range from about 20° C. to about 80° C.

Figure 4A:
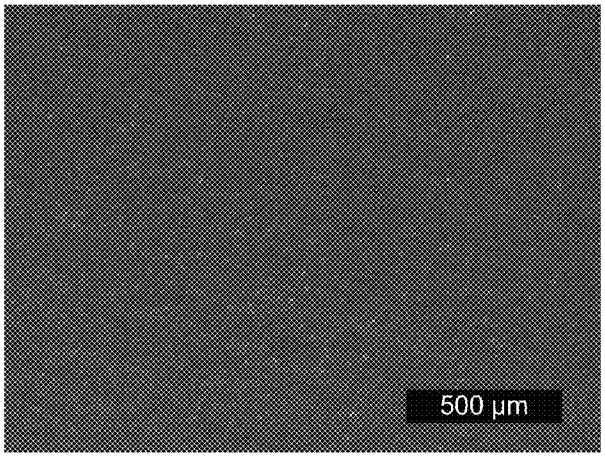
FIGS. 4A-4D are micrographs comparing the results of a standard cleaning method to a method performed according to an embodiment.
Figure 4B:
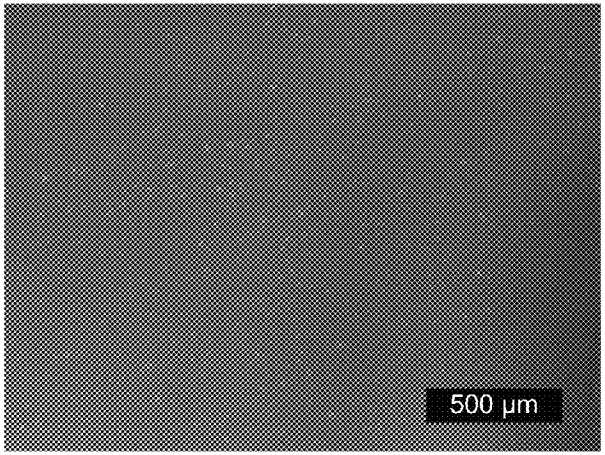
Figure 4C:
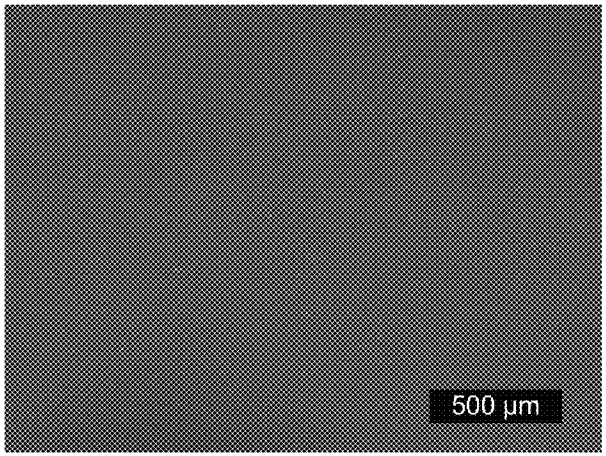
Figure 4D:
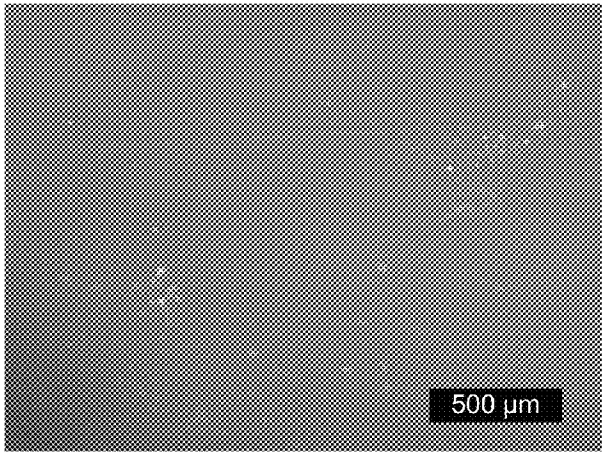

FIGS. 4A-4D are micrographs comparing the results of a standard cleaning method to a method performed according to an embodiment. Each of FIGS. 4A-4D shows a region of an adhesive specimen that was contacted with a portion of a ceramic article to collect loose particles from a surface of the ceramic article (referred to herein as a "tape test"). The particles present on the adhesive specimen directly correlate with a particle defect density on the surface of the ceramic article. In particular, FIGS. 4A-4D correspond to a tape test performed using Kapton tape on a plasma-contacting surface of a nozzle after a standard cleaning process (FIG. 4A), after a single $CO_2$ cleaning cycle (FIG. 4B), after a first and second $CO_2$ cleaning cycle (FIG. 4C), and after a first and second $CO_2$ cleaning cycle after 120 RF hours of operation in a processing chamber (FIG. 4D). FIG. 4B shows improvement over FIG. 4A, and FIG. 4C shows improvement over both FIGS. 4A and 4B. The amount of particles (having a diameter of 1 micrometer or greater) per unit area of tape is less than about 10 particles per square-millimeter for FIG. 4C. It is noted that a particle "diameter" refers to an average end-to-end distance for a particle having an approximate spherical shape. The amount of particles per unit area is greater than 10 particles per square-millimeter for FIG. 4A. Standard cleaning processes typically result in a tape test particle density of greater than 100 particles per square-millimeter. After two cycles of $CO_2$ cleaning, the used nozzle also shows improvement over FIGS. 4A and 4B, indicating that the embodiments described herein are applicable to the refurbishment of used chamber components as well as to new chamber components. The $CO_2$ cleaning cycles are discussed in detail below with respect to FIGS. 5 and 6.

Figure 5:
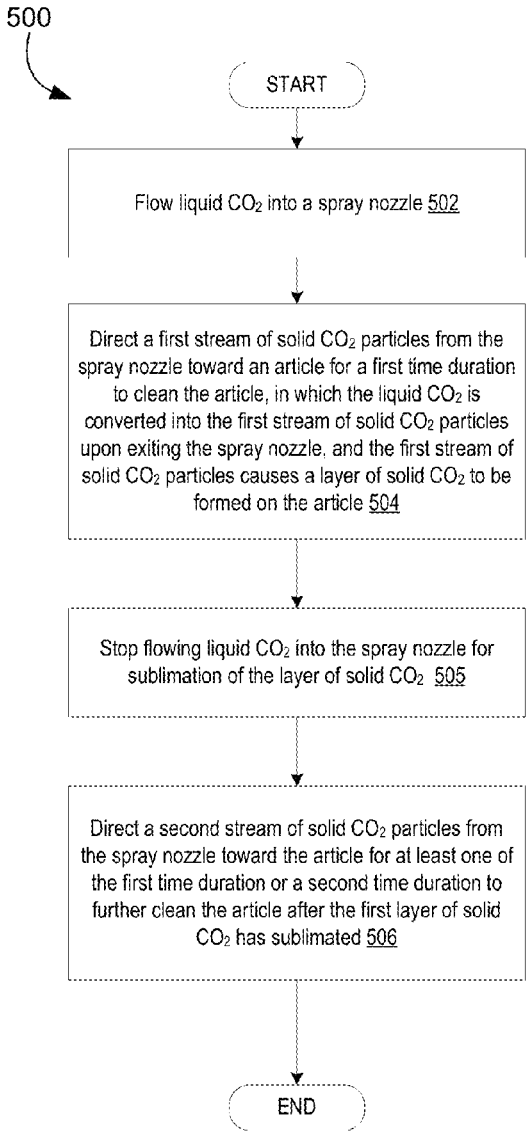
FIG. 5 is a flow diagram illustrating a method for cleaning an article with a stream of solid $CO_2$ particles according to an embodiment.

FIG. 5 is a flow diagram illustrating a method 500 for cleaning an article with a stream of solid $CO_2$ particles according to an embodiment. At block 502, liquid $CO_2$ is flowed into a spray nozzle (e.g., spray nozzle 320 of article cleaning system 300). In one embodiment, a purity of the liquid $CO_2$ is greater than or equal to 99.9999999%. In another embodiment, the purity of the liquid $CO_2$ is less than 99.9999999%. In one embodiment, a pressure of the liquid $CO_2$ is between about 700 psi and about 900 psi. In one embodiment, the pressure of the liquid $CO_2$ is approximately 838 psi.

At block 504, a first stream of solid $CO_2$ particles is directed from the spray nozzle toward an article for a first time duration. In one embodiment, the first time duration may be between about 1 minute and about time minutes. In another embodiment, the first time duration may be between about 3 minutes and about 5 minutes. The liquid $CO_2$ is converted into a stream of solid $CO_2$ upon exiting the spray nozzle. The spray nozzle size and a pressure of the liquid $CO_2$ may have been selected such that a phase transition of the $CO_2$ from liquid to solid occurs prior to the stream contacting the article. In one embodiment, a diameter of an aperture of the spray nozzle through which the stream flows is less than about 1 millimeter. During the first time duration, the first stream of solid $CO_2$ particles causes a first layer of solid $CO_2$ to be formed on the article.

In one embodiment, the spray nozzle is directed at an angle ranging from 15° to 45° with respect to a surface of the ceramic article. In one embodiment, the spray nozzle is maintained at an angle of approximately 30° with respect to a surface of the ceramic article. In one embodiment, a distance from the spray nozzle to the ceramic article is maintained between about 0.5 inches and about 2 inches.

In one embodiment, the article is a component for a semiconductor processing chamber, such as a lid, a nozzle, an electrostatic chuck, a showerhead, a liner kit, or any other suitable chamber component. The article may be a newly fabricated article, or may be a previously used article that is to be refurbished or that has been refurbished. In one embodiment, the article is a metal article such as aluminum, an aluminum alloy, titanium, stainless steel, and so on. In one embodiment, the article is a polymer based material. In one embodiment, the article includes multiple different materials (e.g., a metal base and a ceramic layer over the metal base). In one embodiment, the article is a ceramic article. In one embodiment, the article may be a ceramic article having a composition that includes one or more of $Al_2O_3$, AlN, $SiO_2$, $Y_3Al_5O_{12}$, $Y_4Al_2O_9$, $Y_2O_3$, $Er_2O_3$, $Gd_2O_3$, $Er_3Al_5O_{12}$, $Gd_3Al_5O_{12}$, $YF_3$, $Nd_2O_3$, $Er_4Al_2O_9$, $ErAlO_3$, $Gd_4Al_2O_9$, $GdAlO_3$, $Nd_3Al_5O_{12}$, $Nd_4Al_2O_9$, $NdAlO_3$, or a ceramic compound composed of $Y_4Al_2O_9$ and a solid-solution of $Y_2O_3$—$ZrO_2$. In some embodiments, the article may alternatively or additionally include $ZrO_2$, $Al_2O_3$, $SiO_2$, $B_2O_3$, $Nd_2O_3$, $Nb_2O_5$, $CeO_2$, $Sm_2O_3$, $Yb_2O_3$, or other oxides.

With reference to the ceramic compound composed of $Y_4Al_2O_9$ and a solid-solution of $Y_2O_3$—$ZrO_2$, in one embodiment, the ceramic compound includes 62.93 molar ratio (mol %) $Y_2O_3$, 23.23 mol % $ZrO_2$ and 13.94 mol % $Al_2O_3$. In another embodiment, the ceramic compound can include $Y_2O_3$ in a range of 50-75 mol %, $ZrO_2$ in a range of 10-30 mol % and $Al_2O_3$ in a range of 10-30 mol %. In another embodiment, the ceramic compound can include $Y_2O_3$ in a range of 40-100 mol %, $ZrO_2$ in a range of 0-60 mol % and $Al_2O_3$ in a range of 0-10 mol %. In another embodiment, the ceramic compound can include $Y_2O_3$ in a range of 40-60 mol %, $ZrO_2$ in a range of 30-50 mol % and $Al_2O_3$ in a range of 10-20 mol %. In another embodiment, the ceramic compound can include $Y_2O_3$ in a range of 40-50 mol %, $ZrO_2$ in a range of 20-40 mol % and $Al_2O_3$ in a range of 20-40 mol %. In another embodiment, the ceramic compound can include $Y_2O_3$ in a range of 70-90 mol %, $ZrO_2$ in a range of 0-20 mol % and $Al_2O_3$ in a range of 10-20 mol %. In another embodiment, the ceramic compound can include $Y_2O_3$ in a range of 60-80 mol %, $ZrO_2$ in a range of 0-10 mol % and $Al_2O_3$ in a range of 20-40 mol %. In another embodiment, the ceramic compound can include $Y_2O_3$ in a range of 40-60 mol %, $ZrO_2$ in a range of 0-20 mol % and $Al_2O_3$ in a range of 30-40 mol %. In another embodiment, the ceramic compound can include $Y_2O_3$ in a range of 30-60 mol %, $ZrO_2$ in a range of 0-20 mol % and $Al_2O_3$ in a range of 30-60 mol %. In another embodiment, the ceramic compound can include $Y_2O_3$ in a range of 20-40 mol %, $ZrO_2$ in a range of 20-80 mol % and $Al_2O_3$ in a range of 0-60 mol %. In other embodiments, other distributions may also be used for the ceramic compound.

In one embodiment, an alternative ceramic compound that includes a combination of $Y_2O_3$, $ZrO_2$, $Er_2O_3$, $Gd_2O_3$ and $SiO_2$ is used for the article. In one embodiment, the alternative ceramic compound can include $Y_2O_3$ in a range of 40-45 mol %, $ZrO_2$ in a range of 0-10 mol %, $Er_2O_3$ in a range of 35-40 mol %, $Gd_2O_3$ in a range of 5-10 mol % and SiO2 in a range of 5-15 mol %. In another embodiment, the alternative ceramic compound can include $Y_2O_3$ in a range of 30-60 mol %, $ZrO_2$ in a range of 0-20 mol %, $Er_2O_3$ in a range of 20-50 mol %, $Gd_2O_3$ in a range of 0-10 mol % and SiO2 in a range of 0-30 mol %. In a first example, the alternative ceramic compound includes 40 mol % $Y_2O_3$, 5 mol % $ZrO_2$, 35 mol % $Er_2O_3$, 5 mol % $Gd_2O_3$ and 15 mol % $SiO_2$. In a second example, the alternative ceramic compound includes 45 mol % $Y_2O_3$, 5 mol % $ZrO_2$, 35 mol % $Er_2O_3$, 10 mol % $Gd_2O_3$ and 5 mol % $SiO_2$. In a third example, the alternative ceramic compound includes 40 mol % $Y_2O_3$, 5 mol % $ZrO_2$, 40 mol % $Er_2O_3$, 7 mol % $Gd_2O_3$ and 8 mol % $SiO_2$. In one embodiment, the article includes 70-75 mol % $Y_2O_3$ and 25-30 mol % $ZrO_2$. In a further embodiment, the article is a material entitled YZ20 that includes 73.13 mol % $Y_2O_3$ and 26.87 mol % $ZrO_2$.

In one embodiment, the article may include a plurality of apertures. Each aperture may be of a size range from about 0.01 inches to about 0.1 inches. One or more of the apertures may have a single diameter. Alternatively or additionally, one or more of the apertures may have portions with different diameters. In one embodiment, at least one aperture has a first region having a first diameter and a second region having a second diameter. The first and second regions may be parallel, or may not be parallel but intersect at a common location (e.g., an aperture having a bend).

In one embodiment, one or more ceramic plasma resistant layers are formed on the article. The one or more ceramic plasma resistant layers may be composed of any of the aforementioned ceramics, and may be deposited onto the article by plasma spraying, physical vapor deposition, ion assisted deposition, or other deposition techniques. In one embodiment, one or more non-ceramic layers are formed on the article (e.g., an anodized aluminum layer). In one embodiment, both ceramic and non-ceramic layers may be formed on the article.

Referring back to FIG. 5, at block 505 the first stream of solid $CO_2$ particles may be prevented from contacting the article after the first time duration in order to allow for the first layer of solid $CO_2$ to sublimate. In one embodiment, the liquid $CO_2$ supply is cut-off (e.g., with a pressure valve) such that liquid $CO_2$ is no longer provided to the spray nozzle. In one embodiment, a partition is placed in front of the first stream of solid $CO_2$ particles. In one embodiment, the spray nozzle is automatically oriented away from the article. In one embodiment, the article is automatically moved out of the path of the first stream of solid $CO_2$ particles. In each embodiment, a controller may actuate (based on a process recipe) one or more of the mounting fixture (e.g., mounting fixture 312), a supply line and/or valve (e.g., supply line 324) for providing liquid $CO_2$ to the flow nozzle, or the nozzle orientation and/or distance from the article once the first time duration has passed.

The controller may then (based on the process recipe) allow for a sublimation period (also referred to as a thaw period) to pass before causing a second stream of solid $CO_2$ particles to be directed toward the article. During the sublimation period, the layer of solid $CO_2$ sublimates without leaving behind any residue and without introducing any particle contamination. The sublimation period may be selected to correspond to an amount of time to allow the first solid layer of $CO_2$ ("dry ice") formed on the article to sublimate at least partially. In one embodiment, the sublimation period corresponds to a minimum amount of time to allow for complete sublimation of the first solid layer of $CO_2$. In one embodiment, the length of the sublimation period may be between about 20 and about 40 minutes (e.g., about 30 minutes). In one embodiment, an operator of the article cleaning system may specify the length of the sublimation period directly (e.g., by specifying it in the process recipe). In one embodiment, the article cleaning system may estimate (e.g., using a processing device of the controller) the sublimation period. For example, the article cleaning system may be equipped with components for measuring a temperature of the article (e.g., using a thermocouple), a temperature of the article's environment, an air pressure of the article's environment, a flow rate of liquid $CO_2$, an amount of time the stream was directed toward the article (e.g., the first time duration), etc. The controller may compute (using the processing device) an estimated mass of the solid $CO_2$ layer, and estimate an amount of time for the CO2 to sublimate. The estimated amount of time may also be increased by about 10-20% to account for error in the calculation, which may help ensure that all of the solid $CO_2$ has sublimated.

In one embodiment, the sublimation of the layer of solid $CO_2$ is facilitated by heating the article and/or an environment of the article (e.g., to a temperature between about 10° C. and about 50° C.). This may speed up the rate of sublimation.

At block 506, the liquid $CO_2$ is again flowed into the spray nozzle and a second stream of solid $CO_2$ particles is directed from the spray nozzle toward the article for at least one of the first time duration or a second time duration to further clean the article after the first layer of solid $CO_2$ has sublimated. The second time duration may be longer than, shorter than, or substantially the same as the first time duration. In one embodiment, at least one of the first time duration or the second time duration is between about 2 minutes and about 10 minutes. The second stream of solid $CO_2$ particles may cause a second layer of solid $CO_2$ to be formed on the ceramic article. In some embodiments, the article is contacted with a cleaning solution (e.g., an acetone solution, isopropanol, de-ionized water, etc.) and dried (e.g., using a nitrogen gas flow) after the second layer of solid $CO_2$ has sublimated.

Blocks of method 500 may be repeated to include additional cleaning steps. For example, a third cleaning cycle may be performed after an additional sublimation period. In one embodiment, one or more blocks may be omitted from method 500.

Figure 6:
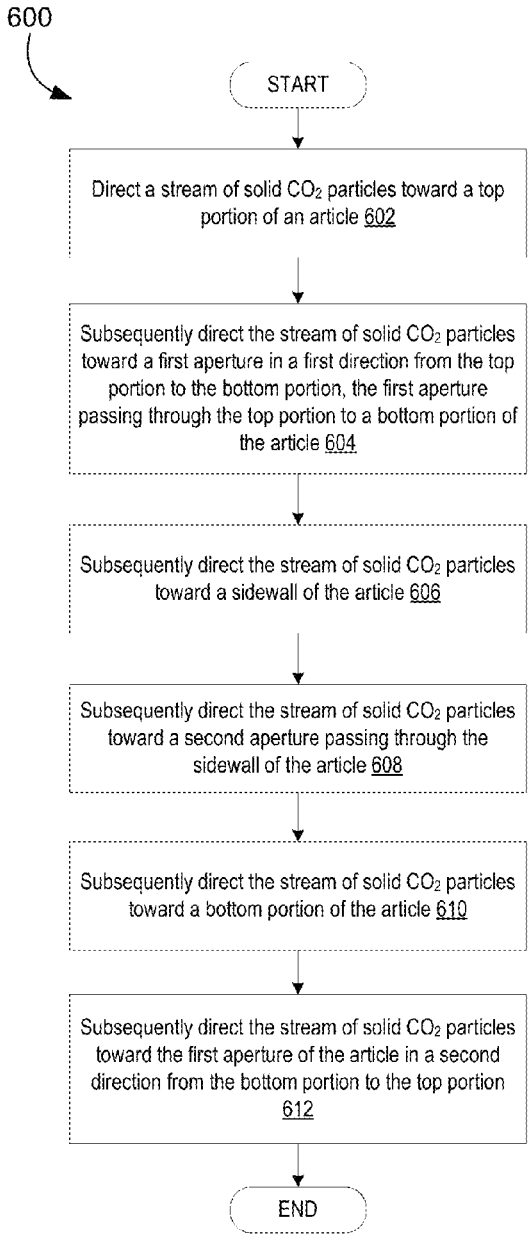
FIG. 6 is a flow diagram illustrating a method for cleaning different portions of an article according to an embodiment.

FIG. 6 is a flow diagram illustrating a method 600 for cleaning different portions of an article according to an embodiment. For example, method 600 may be performed concurrently with one or more of blocks 504 and 506 described with respect to FIG. 5. In some embodiments, method 600 is facilitated by a controller (e.g., the programmable controller of article cleaning system 205). At block 602, a stream of solid $CO_2$ particles is directed toward a top portion of an article (e.g., a top surface). The article may be any suitable ceramic article described herein, such as a component of a semiconductor processing chamber. The ceramic article may include one or more of the ceramic materials described with respect to block 502 of FIG. 5. The article may be a nozzle, and may be similar to the article 302 having the top surface 304, the side surface 308, and the plasma-contacting surface 306, as described with respect to FIG. 3. If the article is a processing chamber component, the top portion may correspond to a surface that is not contacted by a plasma formed during operation of the processing chamber. For other types of chamber components, the non-plasma facing side that is cleaned first may be a bottom or a side of the chamber component.

In one embodiment, the controller actuates the mounting fixture and/or a fixture holding a spray nozzle to orient a face of the article with respect to the stream. The controller may further actuate one or more of the mounting fixture or the fixture holding the spray nozzle such that the stream is swept across the top surface.

At block 604, the stream of solid $CO_2$ particles is subsequently directed toward a first aperture in a first direction from the top portion to the bottom portion of the article. The first aperture may be one or more of apertures 310 passing through article 302 from the top surface 304 to the plasma-contacting surface 306. In one embodiment, the stream may be directed toward one or more additional apertures passing through the article from the top portion to the bottom portion (any of apertures 310) at block 604.

At block 606, the stream of solid $CO_2$ particles is subsequently directed toward a sidewall of the article. In one embodiment, if the article is cylindrical (e.g., has a sidewall that defines a circumference of the article), the actuator may cause the mounting fixture to rotate the article while in contact with the stream. Block 604 may be performed in a manner similar to that of block 602 described above.

At block 608, the stream of solid $CO_2$ particles is subsequently directed toward a second aperture passing through the sidewall of the article (e.g., aperture 311 of article 302). Block 608 may be performed in a manner similar to that of block 604 described above.

At block 610, the stream of solid $CO_2$ particles is subsequently directed toward a bottom portion of the article (e.g., plasma-contacting surface 306 of article 302). Block 610 may be performed in a manner similar to that of blocks 602 and/or 606 described above.

At block 612, the stream of solid $CO_2$ particles is subsequently directed toward the first aperture (e.g., one or more of apertures 310) of the article in a second direction from the bottom portion (e.g., plasma-contacting surface 306) to the top portion (e.g., top surface 304). Block 612 may be performed in a manner similar to that of block 604 described above.

It is noted that method 600 may result in the formation of a solid $CO_2$ layer on each of the top portion, sidewall, and plasma-contacting portions. A sublimation period may be applied before repeating the operations of blocks 602-612.

The preceding description sets forth numerous specific details such as examples of specific systems, components, methods, and so forth, in order to provide a good understanding of several embodiments of the present invention. It will be apparent to one skilled in the art, however, that at least some embodiments of the present invention may be practiced without these specific details. In other instances, well-known components or methods are not described in detail or are presented in simple block diagram format in order to avoid unnecessarily obscuring the present invention. Thus, the specific details set forth are merely exemplary. Particular embodiments may vary from these exemplary details and still be contemplated to be within the scope of the present disclosure.

Reference throughout this specification to "one embodiment" or "an embodiment" indicates that a particular feature, structure, or characteristic described in connection with the embodiment is included in at least one embodiment. Thus, the appearances of the phrase "in one embodiment" or "in an embodiment" in various places throughout this specification are not necessarily all referring to the same embodiment. In addition, the term "or" is intended to mean an inclusive "or" rather than an exclusive "or." When the term "about" or "approximately" is used herein, this is intended to mean that the nominal value presented is precise within ±10%.

Although the operations of the methods herein are shown and described in a particular order, the order of the operations of each method may be altered so that certain operations may be performed in an inverse order or so that certain operation may be performed, at least in part, concurrently with other operations. In another embodiment, instructions or sub-operations of distinct operations may be in an intermittent and/or alternating manner.

It is to be understood that the above description is intended to be illustrative, and not restrictive. Many other embodiments will be apparent to those of skill in the art upon reading and understanding the above description. The scope of embodiments of the invention should, therefore, be determined with reference to the appended claims, along with the full scope of equivalents to which such claims are entitled.

What is claimed is:

1. A method for cleaning a ceramic article, the ceramic article comprising one or more plasma-contacting surfaces and one or more non-plasma-contacting surfaces, wherein, during use of the ceramic article, a plasma contacts the one or more plasma-contacting surfaces without contacting the one or more non-plasma-contacting surfaces, and wherein the method comprises:

flowing liquid $CO_2$ into a spray nozzle;

directing a first stream of solid $CO_2$ particles from the spray nozzle toward the ceramic article for a first time duration to clean the ceramic article, wherein the liquid $CO_2$ is converted into the first stream of solid $CO_2$ particles upon exiting the spray nozzle, wherein the one or more plasma-contacting surfaces are contacted by the first stream of solid $CO_2$ particles after the one or more non-plasma-contacting surfaces are contacted by the first stream of solid $CO_2$ particles to reduce particle defects on the one or more plasma-contacting surfaces, and wherein the first time duration is sufficient for the first stream of solid $CO_2$ particles to cause a first layer of solid $CO_2$ to be formed on the ceramic article; and after the first layer of solid $CO_2$ has sublimated, directing a second stream of solid $CO_2$ particles from the spray nozzle toward the ceramic article for at least one of the first time duration or a second time duration to further clean the ceramic article.

2. The method of claim 1, wherein the second stream of solid $CO_2$ particles causes a second layer of solid $CO_2$ to be formed on the ceramic article, the method further comprising:

contacting the article with a cleaning solution after the second layer of solid $CO_2$ has sublimated.

3. The method of claim 1, wherein at least one of the first time duration or the second time duration is between about 2 minutes and about 10 minutes.

4. The method of claim 1, wherein the spray nozzle is maintained at an angle ranging from 15° to 45° with respect to a surface of the ceramic article.

5. The method of claim 1, wherein the spray nozzle is maintained at an angle of approximately 30° with respect to a surface of the ceramic article.

6. The method of claim 1, wherein directing the first stream of solid $CO_2$ particles from the spray nozzle toward the ceramic article comprises:

directing the first stream of solid $CO_2$ particles toward a top non-plasma-contacting surface of the ceramic article;

subsequently directing the first stream of solid $CO_2$ particles toward a side non-plasma-contacting surface of the ceramic article; and subsequently directing the first stream of solid $CO_2$ particles toward the one or more plasma-contacting surfaces of the ceramic article.

7. The method of claim 1, wherein the ceramic article is a nozzle, and wherein the one or more non-plasma-contacting surfaces comprise a top surface, a side surface, and a bottom surface, wherein:

the top surface comprises a first aperture passing through the ceramic article to the bottom surface, and the side surface comprises a second aperture passing through the ceramic article, wherein directing the first stream of solid $CO_2$ particles from the spray nozzle toward the plurality of surfaces of the ceramic article comprises:

directing the first stream of solid $CO_2$ particles toward the top surface of the ceramic article;

subsequently directing the first stream of solid $CO_2$ particles toward the first aperture in a first direction from the top surface to the bottom surface;

subsequently directing the first stream of solid $CO_2$ particles toward the side surface of the ceramic article;

subsequently directing the first stream of solid $CO_2$ particles toward the second aperture;

subsequently directing the first stream of solid $CO_2$ particles toward the bottom surface of the ceramic article; and subsequently directing the first stream of solid $CO_2$ particles toward the first aperture in a second direction from the bottom surface to the top surface.

8. The method of claim 1, wherein a pressure of the liquid $CO_2$ is between about 700 psi and about 900 psi.

9. The method of claim 1, wherein a pressure of the liquid $CO_2$ is approximately 838 psi.

10. The method of claim 1, wherein a distance from the spray nozzle to the ceramic article is maintained between about 0.5 inches and 2 inches.

11. The method of claim 1, wherein the ceramic article is a chamber component selected from the group consisting of: a lid, a nozzle, a showerhead, and a liner kit.

12. The method of claim 1, wherein the ceramic article comprises at least one of $Y_3Al_5O_{12}$, $Y_4Al_2O_9$, $Y_2O_3$, $Er_2O_3$, $Gd_2O_3$, $Er_3Al_5O_{12}$, $Gd_3Al_5O_{12}$, $YF_3$, $Nd_2O_3$, $Er_4Al_2O_9$, $ErAlO_3$, $Gd_4Al_2O_9$, $GdAlO_3$, $Nd_3Al_5O_{12}$, $Nd_4Al_2O_9$, $NdAlO_3$, or a ceramic compound comprising $Y_4Al_2O_9$ and a solid-solution of $Y_2O_3$—$ZrO_2$.

13. The method of claim 1, wherein a purity of the liquid $CO_2$ is at least 99.9999999%.

14. An apparatus for cleaning a ceramic article, the ceramic article comprising one or more plasma-contacting surfaces and one or more non-plasma-contacting surfaces, wherein, during use of the ceramic article, a plasma contacts the one or more plasma-contacting surfaces without contacting the one or more non-plasma-contacting surfaces, and wherein the apparatus comprises:

a mounting fixture;

a spray nozzle to generate a stream of solid $CO_2$ particles toward the ceramic article held by the mounting fixture; and a controller, wherein the controller is configured to:

direct the stream of solid $CO_2$ particles toward the ceramic article for a first time duration to clean the ceramic article, wherein the one or more plasma-contacting surfaces are contacted by the first stream of solid $CO_2$ particles after the one or more non-plasma-contacting surfaces are contacted by the first stream of solid $CO_2$ particles to reduce particle defects on the one or more plasma-contacting surfaces, and wherein the first time duration is sufficient for the stream of solid $CO_2$ particles to cause a first layer of solid $CO_2$ to be formed on the ceramic article;

stop the stream of solid $CO_2$ particles for a second time duration, wherein the first layer of solid $CO_2$ is sublimated during the second time duration; and after the first layer of solid $CO_2$ has sublimated, direct the stream of solid $CO_2$ particles toward the ceramic article for a third time duration to further clean the ceramic article.

15. The apparatus of claim 14, wherein one or more of the spray nozzle or mounting fixture is arranged to cause the stream of solid $CO_2$ particles to contact a surface of the ceramic article at an angle ranging from 15° to 45° with respect to the surface of the ceramic article.

16. The apparatus of claim 14, wherein at least one of the first duration or the third time duration is between about 2 minutes and about 10 minutes.

17. The apparatus of claim 14, further comprising:

a liquid $CO_2$ source fluidly coupled to the spray nozzle, wherein a pressure of liquid $CO_2$ delivered to the spray nozzle is between about 700 psi and about 900 psi.

18. The apparatus of claim 14, wherein the mounting fixture is configured to expose a top non-plasma-contacting surface of the ceramic article to the stream of solid $CO_2$ particles, expose a side non-plasma-contacting surface of the ceramic article to the stream of solid $CO_2$ particles after exposing the top non-plasma-contacting surface, and expose the one or more plasma-contacting surfaces of the ceramic article to the stream of solid $CO_2$ particles after exposing the side non-plasma-contacting surface.

19. The apparatus of claim 14, wherein the ceramic article is a semiconductor chamber component selected from the group consisting of: a lid, a nozzle, a showerhead, and a liner kit.

* * * * *